US005918585A

United States Patent [19]

Blanchard

[11] Patent Number: 5,918,585

[45] Date of Patent: Jul. 6, 1999

[54] SIGHTED SLING SHOT

[76] Inventor: Gordon Ray Blanchard, 2309 S. 96th St., #502, Tacoma, Wash. 98444

[21] Appl. No.: 09/088,938

[22] Filed: Jun. 2, 1998

[51] Int. Cl.[6] ..... F41B 3/02

[52] U.S. Cl. ..... 124/20.1

[58] Field of Search ..... 124/20.1, 20.3

[56] References Cited

U.S. PATENT DOCUMENTS

| | | | |
|---|---|---|---|
| 1,072,988 | 9/1913 | Pratt et al. | 124/20.1 X |
| 2,667,863 | 2/1954 | Styles | 124/20.1 |
| 2,820,444 | 1/1958 | Pedersen | 124/20.1 |
| 4,198,949 | 4/1980 | Cook | 124/20.1 |
| 4,411,248 | 10/1983 | Kivenson | 124/20.1 |
| 5,632,262 | 5/1997 | Hanson | 124/20.1 |
| 5,762,056 | 6/1998 | Kysilka | 124/20.3 |
| 5,803,067 | 9/1998 | Ellenburg et al. | 124/20.1 |

FOREIGN PATENT DOCUMENTS

| | | | |
|---|---|---|---|
| 626879 | 7/1949 | United Kingdom | 124/20.1 |

*Primary Examiner*—John A. Ricci
*Attorney, Agent, or Firm*—David L. Tingey

[57] ABSTRACT

A traditional sling shot is provided with a sighting mechanism on its upper elastic strap, typically a plurality of marks spaced apart along the strap in a vertical array of horizontal rises, colorations, or channels on a strap alignment side opposite the sling shot handle when the strap is loaded and stretched back into firing position with the handle horizontal and the strap generally vertical. The marks are calibrated to represent respective distances a shot of known size and weight will travel when a respective mark is aligned between the user and a target. The rise may comprise a ring, such as an elastic ring, around the strap biased to remain in a selective position on the strap but adjustable by sliding or rolling the ring along the strap to a preferred position.

14 Claims, 2 Drawing Sheets

SIGHTED SLING SHOT

FIELD OF THE INVENTION

The present invention relates generally to sling shots for propelling a projectile toward a target, and, more specifically, to sighting mechanisms for such traditional sling shots.

BACKGROUND

Sling shots have been used since ancient times. A traditional sling shot comprises a handle and pair of arms diverging therefrom to form a "Y" configuration, generally. To the distal ends of the arms are connected one end of elastic straps with the straps joined together at a pouch useful for holding a projectile. In operation, the sling shot is oriented somewhere between the handle in horizontal position to the handle in vertical position. For purposes of this patent, the handle is to be considered to be in horizontal orientation with the one of the arms, designated the upper arm, above the other, or lower, arm.

The traditional sling shot is without a sighting mechanism. A user simply estimates a distance to a target and elevates the sling shot a degree the user guesses to be sufficient for the sling shot projectile to reach the target. With accuracy and reproducibility needed for sport shooting and hunting, this traditional sighting approach is lacking.

There have been sighting mechanisms suggested for sling shots. Typically, they comprise a device attached to the sling shot arms which makes it difficult to align the sling shot sighting mechanism on the target. To allow the projectile a passage through the sling shot between the arms without hitting the sighting mechanism requires the sighting mechanism to be somewhat offset from the target. Accuracy is therefore compromised to the degree the target cannot be directly aligned. To partially overcome the offset of the sighting mechanism, another approach is to place the sighting mechanism between the arms, essentially in the path, at least potentially, of the projectile as it passes between the arms. To align the target precisely with the sighting mechanism between the sling shot arms is to place the sighting mechanism directly in the path of the projectile. This is inherently unsafe for the user and will at least somewhat alter the path of the projectile.

Accordingly, the object of the present invention is to provide a sighting mechanism precisely alignable with the target and calibrated to compensate for distance to a target.

It is a further object that the sighting mechanism not be in the path or nearly in the path of the sling shot projectile.

It is another object that the sighting mechanism provide for reproducible sighting and projectile positioning toward a target.

It is another object that the sighting mechanism be calibrated through a range of distances to targets.

It is a final object that the sighting mechanism be adjustable to calibrate the sighting mechanism to compensate for a change in conditions, such as wind speed or shot size and weight.

SUMMARY OF THE INVENTION

These and other objects are achieved in a traditional sling shot having a sighting mechanism on its upper elastic strap instead of on or between the sling shot arms. Although the sighting mechanism may comprise a single mark that may be aligned between the user and the target, typically it comprises a plurality of marks spaced apart along the strap. When the strap is loaded and stretched back into firing position, the marks present as a vertical array of rises, colorations, or channels on an alignment side of the strap away from the sling shot handle. The marks are calibrated to represent respective distances a shot of known size and weight will travel when a respective mark is aligned between the user and a target. The rise may comprise a ring, such as an elastic ring, around the strap biased to remain in a selective position on the strap but adjustable by sliding or rolling the ring along the strap to a preferred position.

DETAILED DESCRIPTION OF THE PREFERRED EMBODIMENT

Figure 1:
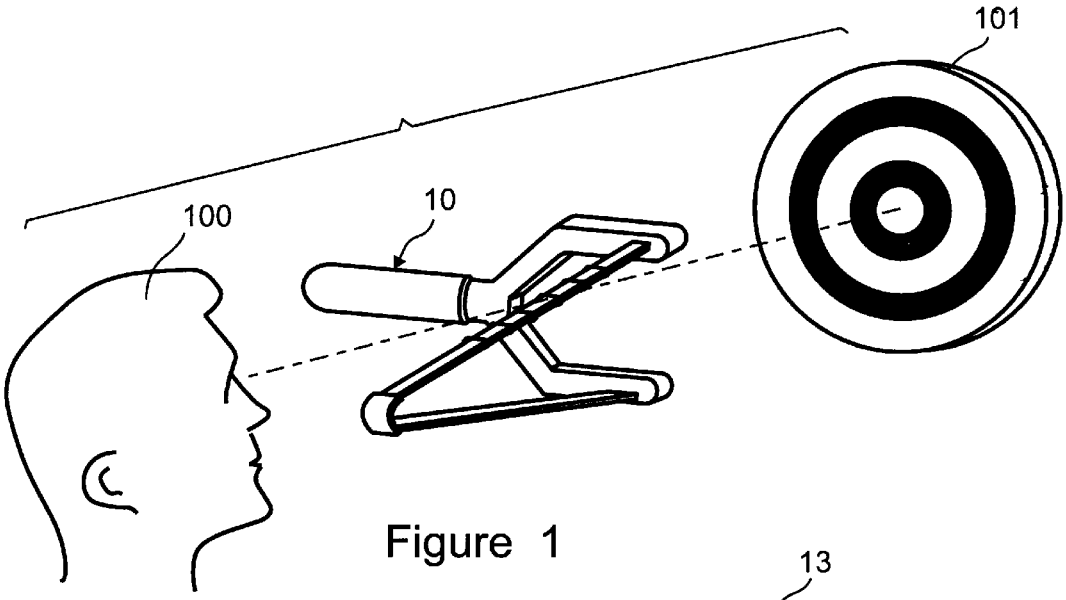
FIG. 1 is a prospective view of a user employing the sighted sling shot of the present invention to adjust the elevation of the sling shot in alignment with a sling shot sight mechanism corresponding to a distance of the user from the target.
Figure 2:
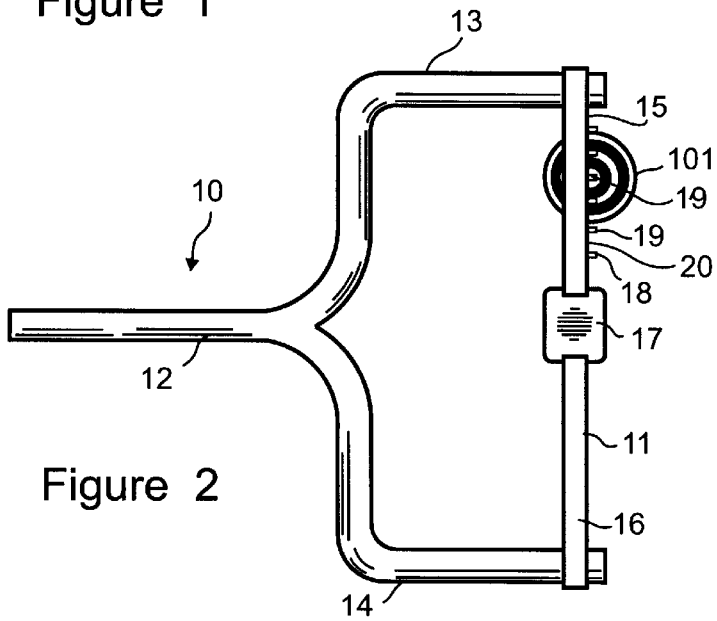
FIG. 2 is a front view the sighted sling shot of the present invention showing an array of rises extending from an alignment side of the strap.
Figure 3:
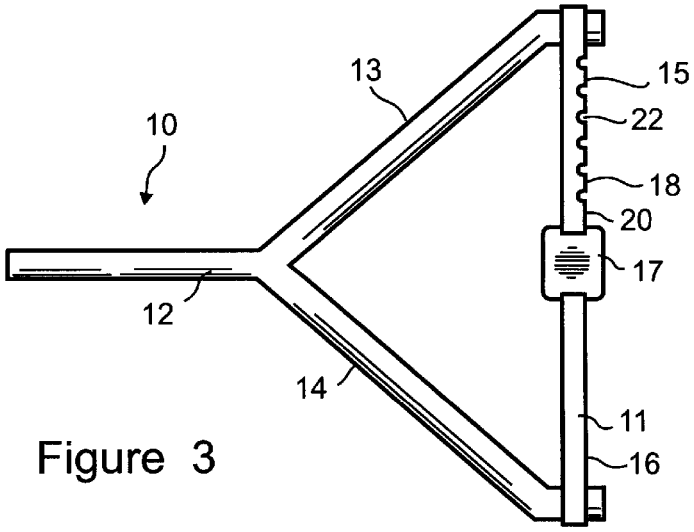
FIG. 3 is a front view showing a series of channels comprising the sighting mechanism.
Figure 4:
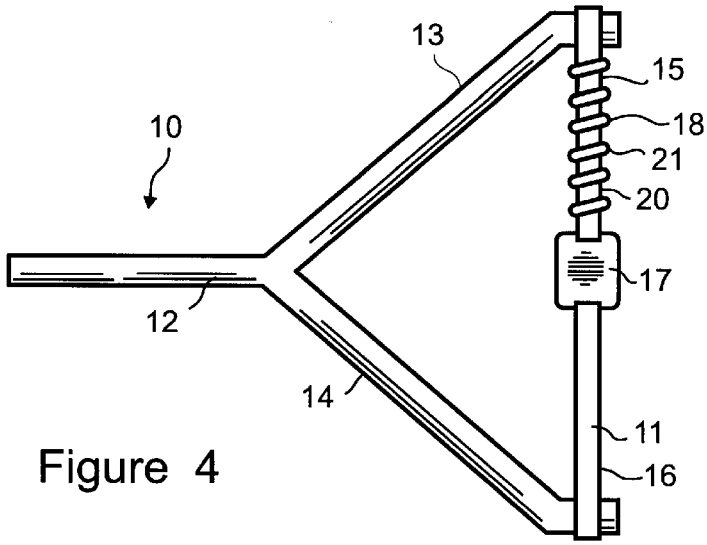
FIG. 4 is a front view showing a spiraling wind on the strap upper protion.
Figure 5:
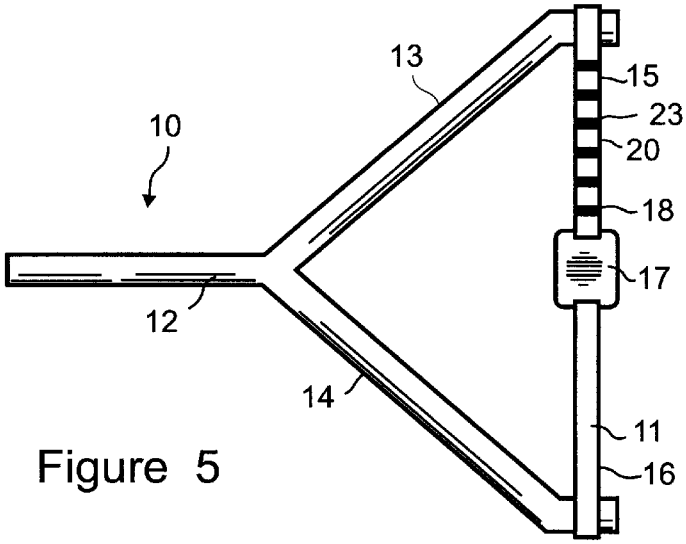
FIG. 5 is a front view showing a series of contrasting spaced-apart colorations along the upper strap.
Figure 6:
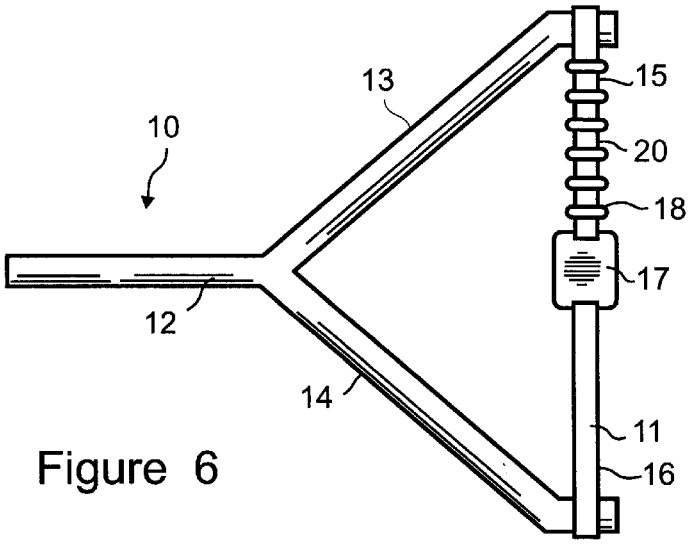
FIG. 6 is a front view showing a series of elastic adjustable rings on the upper strap comprising the array of extending rises of FIG. 2.

The sling shot 10 of the present invention comprises an elastic strap 11 and a handle 12 branching into opposing upper and lower arms 13 and 14. The strap is divided into an upper portion 15 and a lower portion 16 by a shot pouch 17. The upper portion is attached to the upper arm and the lower portion is attached to the lower arm. A sighting mechanism 18 on the strap upper portion is alignable between a user's eye 100 and a target 101 such that when the sling shot is held with the handle and arms horizontal and the strap vertical, the sight mechanism is viewable on the strap.

The sight mechanism in a first embodiment is a rise 19 from the strap upper portion 15, typically extending from the strap 11 on an alignment side 20 away from the sling shot handle 12. A single rise 19 may suffice, or the sight mechanism may comprise a plurality of rises extending on the strap upper portion in a vertical array disposed linearly on the strap. Each rise is then alignable between a user's eye and a target corresponding to a given distance such that the respective rises of the vertical array each gauges a distance measure of a shot propelled from the sling shot, a given rise corresponding to a distance shorter than a rise relatively higher on the strap, a lowest rise being closest to the shot pouch. The plurality of rises may derive from a spiralling wind 21 on the strap upper portion.

The sling shot rises may be adjustable in location on the strap for calibrating a distance for the sling shot. For example, one or more rises may comprise an elastic ring around the strap, rollable or slidable on the strap but with an elastic bias causing the ring to adhere to the strap until urged to a different position.

In an alternative embodiment, the sling shot sight mechanism may be a channel, or slot, in the strap 11 , or a series of spaced-apart channels 22, each channel alignable between a user's eye and a target and similarly corresponding to a given distance as with the rise embodiment.

In a further embodiment, the sight mechanism may be a coloration on alignment strap side or a series of colorations 23 contrasting with the strap itself. In this embodiment, the user aligns a chosen coloration calibrated for a given distance between the user's eye and the target. The series of colorations on the alignment side may comprise a spiralling coloration on the strap presenting as a series of colorations to a user on the alignment side.

In targeting and sighting operation, a user loads a shot of standard size and weight into the sling shot and estimates distance to a target. The sighting mechanism is brought into rough alignment with the target by aiming the sling shot at the target generally, the sling shot handle and arms horizontal and the strap generally vertical. With the user's estimate of distance to target, the user aligns the sight rise, coloration, or channel calibrated to correspond to the distance to target with the target by elevating the sling shot appropriately.

I claim:

1. A sling shot including an elastic strap and a handle branching into opposing upper and lower arms to which ends of the strap are attached respectively, the strap divided into an upper portion and a lower portion by a shot pouch, the upper portion attached to the upper arm and the lower portion attached to the lower arm, the improvement including a sighting mechanism comprising at least one sight mechanism on the elastic strap alignable between a user's eye and a target such that when the sling shot is held with the handle and arms horizontal and the strap vertical, the at least one sight mechanism is viewable on the strap.

2. The sling shot of claim 1 in which the sight mechanism is a rise from the strap.

3. The sling shot of claim 2 in which the rise extends from the strap away from the sling shot handle.

4. The sling shot of claim 1 in which the sight mechanism is on the strap upper portion.

5. The sling shot of claim 1 further comprising a plurality of sight mechanisms on the strap.

6. The sling shot of claim 5 in which said plurality of sight mechanisms is on the upper portion of the strap.

7. The sling shot of claim 5 in which the plurality of sight mechanisms comprise a vertical array disposed linearly on the strap each alignable between a user's eye and a target and corresponding to a given distance such that the sight mechanisms of the vertical array gauge a distance measure of a shot from the sling shot, a given sight mechanism corresponding to a distance shorter than a sight mechanism relatively higher on the strap, a lowest sight mechanism being closest to the shot pouch.

8. The sling shot of claim 5 in which the plurality of sight mechanisms is a plurality of colorations spaced apart on the strap presenting as a series of colorations to a user.

9. The sling shot of claim 1 in which the sight mechanism is a channel in the strap.

10. The sling shot of claim 1 in which the sight mechanism is a coloration on the strap.

11. The sling shot of claim 1 in which the sight mechanism is adjustable in location on the strap as a distance calibration for the sling shot.

12. The method of targeting a sling shot including an elastic strap and a pouch intermediate the strap, comprising the following steps:

a. Loading a shot of standard size and weight into the sling shot;

b. Estimating distance to a target;

c. Aiming the sling shot at the target generally;

d. Adjusting the sling shot and its aim for distance to the target by elevating the aim of the sling shot;

e. Aligning aim of the sling shot with a sight mechanism on the sling shot elastic strap calibrated as a measure of distance a projectile shot from the sling shot is expected to travel.

13. The method of claim 12 further comprising the step of selecting said sight mechanism from a plurality of sight mechanisms on the sling shot elastic strap, collectively arrayed as a measure of distance said projectile shot from the sling shot is expected to travel with each sight mechanism corresponding to different distance of expected projectile travel.

14. The method of claim 12 further comprising the step of adjusting the sight mechanism on the sling shot elastic strap to correspond to the estimated distance of projectile travel with shorter distances corresponding to locating the sight mechanism closer to the sling shot pouch and conversely with longer distances corresponding to locating the sight mechanism on the strap farther from the pouch.

* * * * *